US008684186B2

(12) United States Patent
Westgard

(10) Patent No.: US 8,684,186 B2
(45) Date of Patent: Apr. 1, 2014

(54) SIFTING IMPLEMENT AND METHODS OF USING THE SAME

(76) Inventor: Carl T. Westgard, Golden, CO (US)

( * ) Notice: Subject to any disclaimer, the term of this patent is extended or adjusted under 35 U.S.C. 154(b) by 0 days.

(21) Appl. No.: 13/483,907

(22) Filed: May 30, 2012

(65) Prior Publication Data

US 2012/0305455 A1 Dec. 6, 2012

Related U.S. Application Data

(60) Provisional application No. 61/520,028, filed on Jun. 3, 2011.

(51) Int. Cl.
*F24B 15/00* (2006.01)

(52) U.S. Cl.
USPC ..... 209/370; 209/417; 209/420

(58) Field of Classification Search
USPC ..... 209/370, 417, 420
See application file for complete search history.

(56) References Cited

U.S. PATENT DOCUMENTS

| | | | | | |
|---|---|---|---|---|---|
| 5,423,430 | A | * | 6/1995 | Zaffiro et al. | 209/315 |
| D373,291 | S | * | 9/1996 | Auker | D8/1 |
| 5,622,266 | A | * | 4/1997 | Curtis | 209/235 |
| D512,284 | S | * | 12/2005 | Massey | D8/1 |
| D571,168 | S | * | 6/2008 | Sais | D8/1 |
| 8,113,355 | B1 | * | 2/2012 | Peterson | 209/235 |

* cited by examiner

*Primary Examiner* — Michael McCullough
(74) *Attorney, Agent, or Firm* — Perkins Coie LLP

(57) ABSTRACT

A sifting implement for use with a container, such as a wheelbarrow or bucket. The sifting implement includes a frame having an opening through which compost, dirt, rocks, sand, or other material is sifted. A primary screen is supported in the opening to catch larger items in the material being sifted. Other screens are used for separating different size materials. A bracket is attached to the implement and engages an edge of the container, which allows the implement to be tilted in order to dump the larger items. The sifting implement also includes a containment border disposed around the opening to direct the separated items toward the front of the implement when the implement is tilted to dump the items.

15 Claims, 20 Drawing Sheets

SIFTING IMPLEMENT AND METHODS OF USING THE SAME

CROSS REFERENCE TO RELATED APPLICATIONS

This application claims the benefit of U.S. Provisional Application No. 61/520,028, filed Jun. 3, 2011, the disclosure of which is hereby incorporated by reference in its entirety.

BACKGROUND

Creating and maintaining landscapes and gardens is a popular and satisfying pastime for many individuals. Landscaping and gardening usually involve handling particulate matter such as dirt, sand, compost, rocks, pebbles, and the like. It is not uncommon for these materials to become mixed together or become contaminated with undesirable foreign materials such as twigs, sticks, pine needles, etc.

There is a heretofore unrecognized need for a device that facilitates separating various landscaping materials, such as those described above. For example, it is extremely difficult and time consuming to remove pine needles from landscaping rock. As a further example, compost often includes rocks and sticks that can render the compost undesirable for use in a flower bed, for instance. Accordingly, professionals, hobbyists, and home owners can benefit from a device that easily and efficiently allows them to separate landscaping materials.

SUMMARY

Provided herein is a sifting implement for use with a container, such as a wheelbarrow or bucket. The disclosed sifting implement is a hand-operated device, or tool, for manually screening, working, sizing, and dumping soil, sod, dirt, compost, decorative rocks, and the like. The implement sits atop a wheelbarrow, cart, bucket or other container. The sifting implement comprises several components including a frame or working platform, typically of molded plastic, metal, or wood, with a built-in or primary large mesh screen. Additional components include one or more relatively smaller mesh screens (secondary and tertiary screens) that are congruent with the primary screen and are sized to sit atop the primary screen. The smaller screens may include a handle for ease of installation and removal and in order to assist in manually working materials through the screens. A bracket or clip is located on the bottom front side of the platform and is operative to engage the front lip of a wheelbarrow, cart, or other container when the frame is raised up from the rear, by the user, allowing material on top of the screen(s) to be dumped off of the platform and over the front of the wheelbarrow or cart. The bracket engages the lip of the wheelbarrow or cart, preventing the frame from slipping forward off the edge of the wheelbarrow or cart and thus allows the contents of the sifting implement to flow by gravity off, forward, and onto the ground or other surface. The undersized materials from the screening/sifting process drop into and are contained within the wheelbarrow container and may be further worked through different mesh size screens, discarded, or put to use directly as landscape or garden material as desired.

In an exemplary embodiment, the sifting implement includes a frame having an opening through which compost is sifted. A primary screen is supported in the opening to catch larger items in the material being sifted. A bracket is attached to the implement and engages an edge of the container, which allows the implement to be tilted in order to dump the larger items. The sifting implement may further comprise a containment border disposed around the opening to direct the separated items toward the front of the implement when the implement is tilted to dump the items.

The implement may include a pair of handles disposed on a first end of the frame that facilitate tilting the implement. The bracket, which may be in the form of a hook, is located on a second end of the frame opposite the first end. Alternatively, the bracket may be fastened to the primary screen.

In one aspect of the technology described herein, the implement may further comprise a secondary screen disposed in the opening adjacent the primary screen. The primary screen has a first mesh size and the secondary screen has a second mesh size smaller than the first mesh size. The secondary screen may include a handle to facilitate removing the secondary screen from the opening. In another aspect of the described technology, the implement may include a tertiary screen disposed in the opening adjacent the secondary screen.

In another exemplary embodiment, the sifting implement is designed for use with a wheelbarrow. In this case, the implement comprises an elongate frame including first and second end portions and a rectangular opening. A primary screen is supported in the opening. A pair of handles are disposed on the first end portion and a bracket is attached to the second end portion. The bracket is operative to engage an edge of a wheelbarrow container to facilitate tilting the sifting implement. The implement may further comprise at least one insert member disposed in a countersunk region formed in the frame, wherein the screen is disposed in the countersunk region between the insert and frame.

In yet another exemplary embodiment, the sifting implement is designed for use with a bucket. In this embodiment, the sifting implement includes a frame that includes a circular opening. A screen is supported in the opening. A handle is disposed on the frame and a bracket is attached to the implement adjacent to the perimeter of the opening that is operative to engage an edge of a bucket. The implement may further comprise an insert disposed in a countersunk region formed in the frame, wherein the screen is disposed in the countersunk region between the insert and the frame.

These and other aspects of the disclosed technology will be apparent after consideration of the Detailed Description and Figures herein. It is to be understood, however, that the scope of the invention shall be determined by the claims as issued and not by whether given subject matter addresses any or all issues noted in the background or includes any features or aspects recited in this summary.

DRAWINGS

Non-limiting and non-exhaustive embodiments of the sifting implement, including the preferred embodiment, are described with reference to the following figures, wherein like reference numerals refer to like parts throughout the various views unless otherwise specified.

DETAILED DESCRIPTION

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense.

Figure 1:
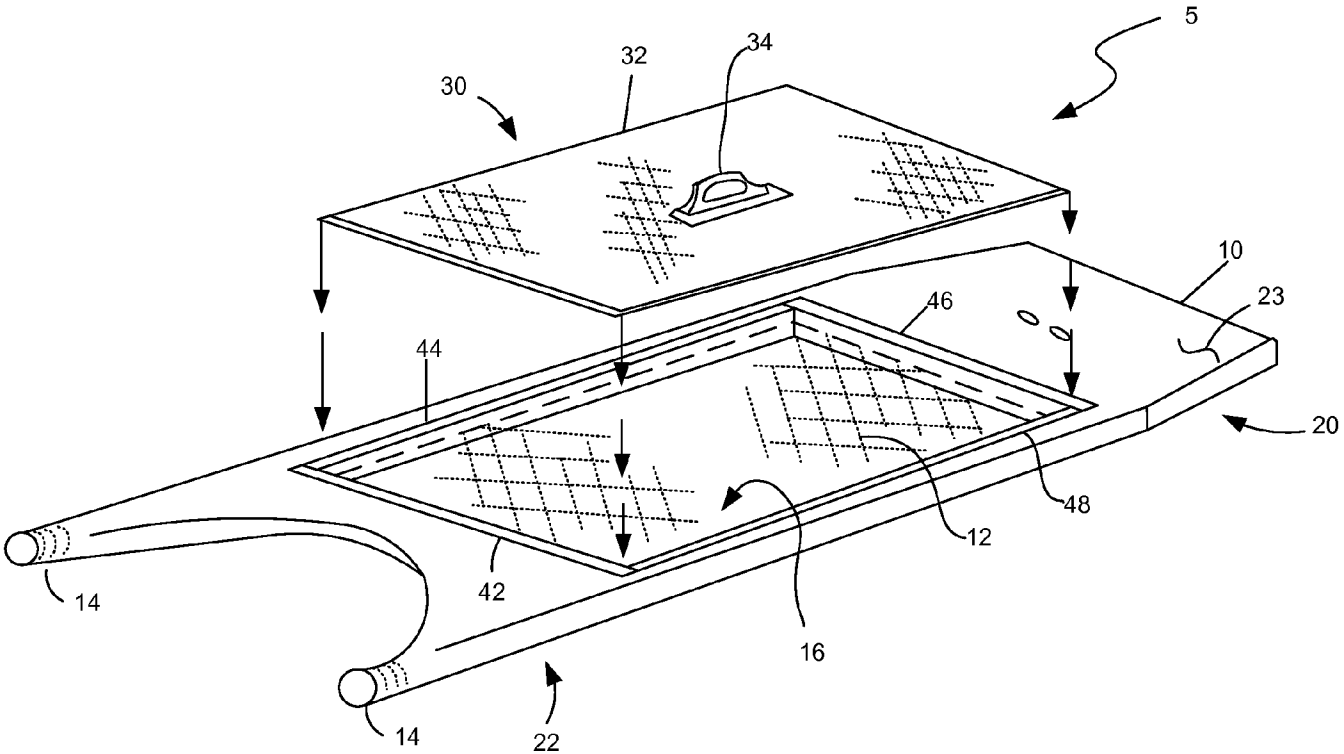
FIG. 1 is a perspective view of a sifting implement according to a first exemplary embodiment.

Disclosed herein is a sifting implement for use with a container such as a wheelbarrow, a garden cart, or a bucket, for example. As shown in FIG. 1, a sifting implement according to a first exemplary embodiment 5 includes a frame 10, also referred to herein as a platform. Frame 10 includes an opening 16 with a screen 12 supported therein. In this embodiment, the sifting implement 5 also includes a secondary screen 30. Secondary screen 30 includes a screen 32 with a handle 34 fastened thereto. In this case, the primary screen 12 has a first mesh size, and the secondary screen 32 has a second mesh size that is smaller than the first mesh size. For example, the primary screen's mesh size may be approximately ¾-inch, while the secondary screen mesh size may be approximately ½ inch in mesh size. Other mesh sizes may be used as desired.

Figure 2:
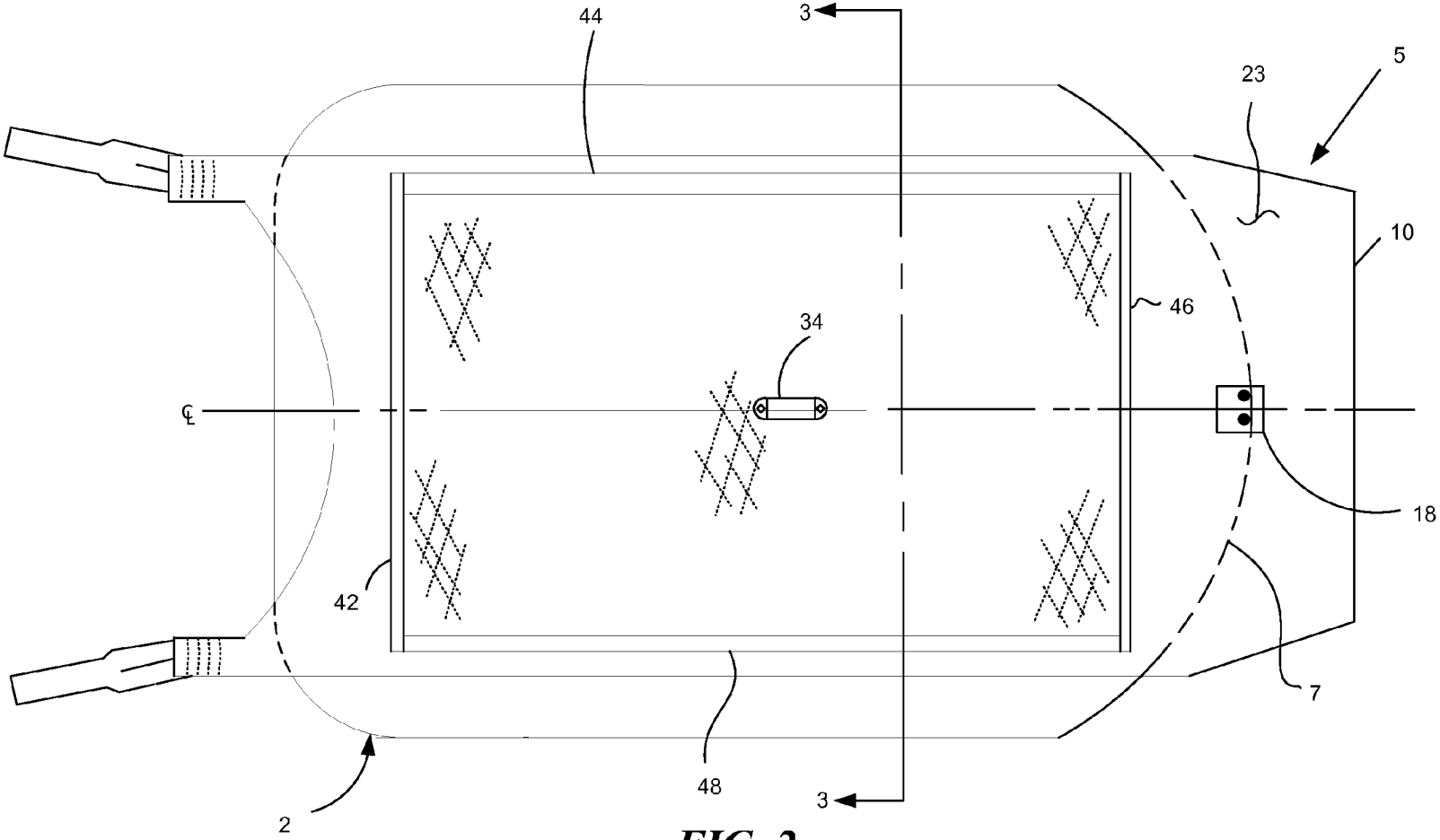
FIG. 2 is a top plan view of the sifter implement shown in FIG. 1 disposed on top of a wheelbarrow.
Figure 3:
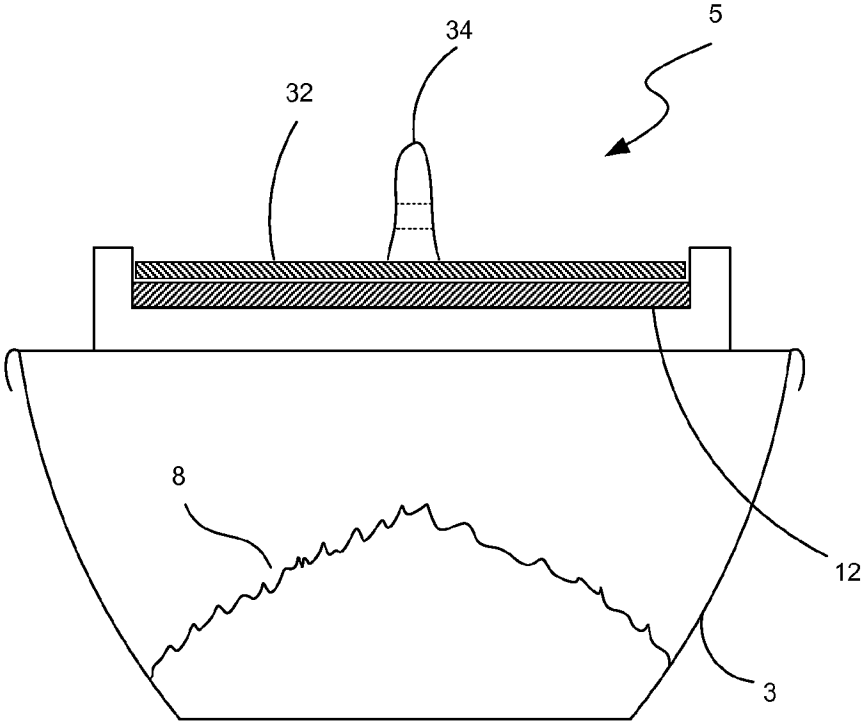
FIG. 3 is a cross-sectional view of the sifting implement and wheelbarrow container taken about line 3-3 in FIG. 2.

With further reference to FIGS. 2 and 3, it can be appreciated that the sifting implement 5 is sized, in this case, to fit on top of a wheelbarrow 2. The wheelbarrow 2 includes a wheelbarrow container 3 which may receive various materials 8, such as pine needles, dirt, compost, etc. In this embodiment, it is contemplated that the frame is constructed of wood, such as plywood, laminated wood materials, solid hardwood, oriented strand board (OSB), and the like. However, the frame may be formed from other materials such as plastic, metal, or sheet metal, for example. Plastic materials may be injection molded, blow molded, or thermoformed all processes of which are well known in the art.

Figure 4:
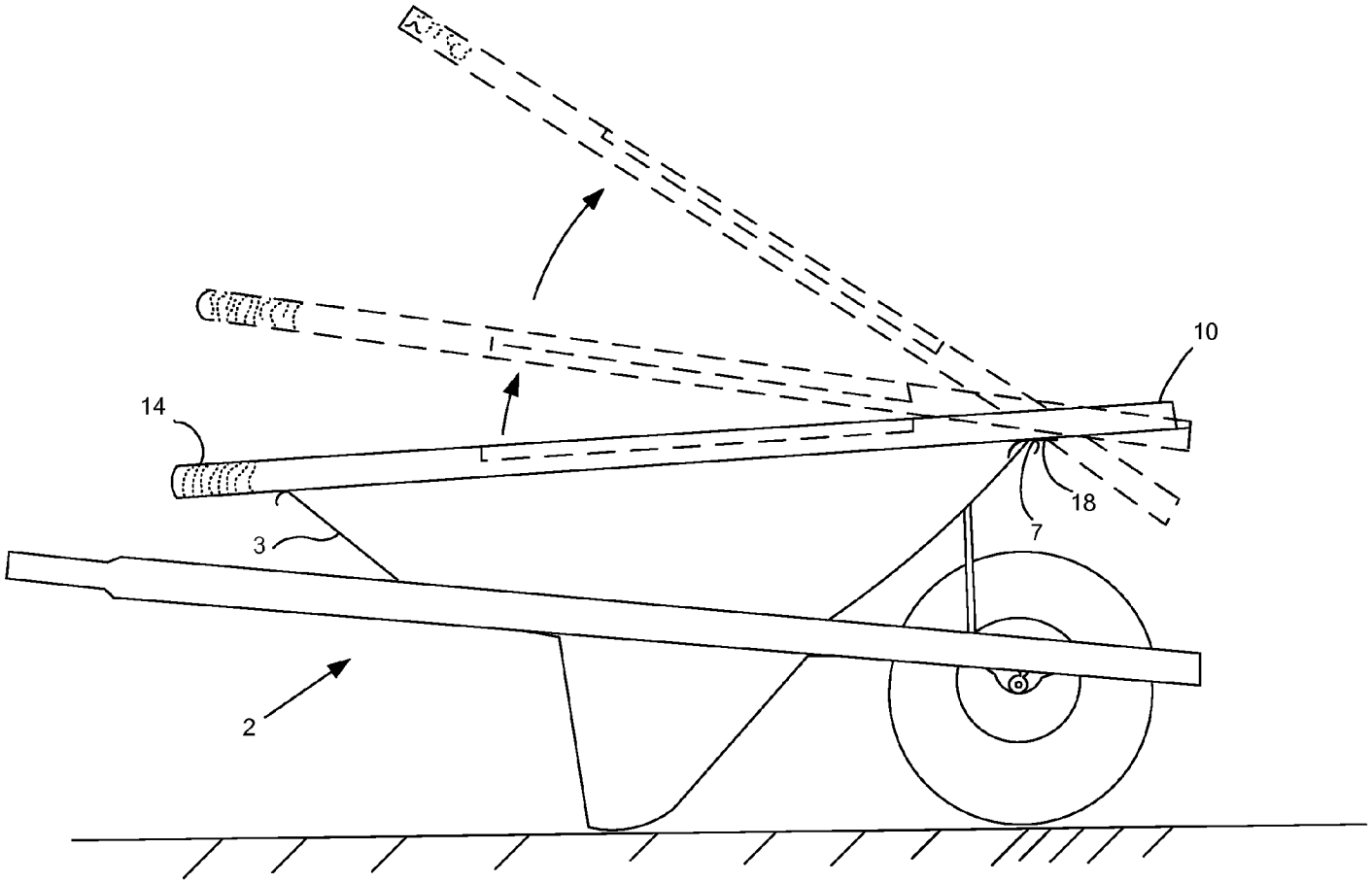
FIG. 4 is a side view in elevation of the sifting implement shown in FIGS. 1-3 which illustrates the tilting action of the sifting implement.

It should also be appreciated with reference to FIG. 2 that the sifting implement 5 includes a tilting bracket 18 that is fastened to the bottom surface 25 (see FIG. 5) of frame 10. Referring now to FIG. 4, it can be appreciated that tilting bracket 18 is operative to engage an edge or lip 7 of the wheelbarrow container 3. As shown in FIG. 4, the screener implement 5 may be tilted upward such that the bracket 18 engages lip 7 and allows any material that was screened out of the material sifted to be dumped towards the front of the wheelbarrow 2. The screener implement 5 also includes a pair of handles 14 disposed on a first end portion 22 of the frame 10. Accordingly, the bracket 18 is disposed on a second end portion 20, which is located opposite the first end.

Figure 5:
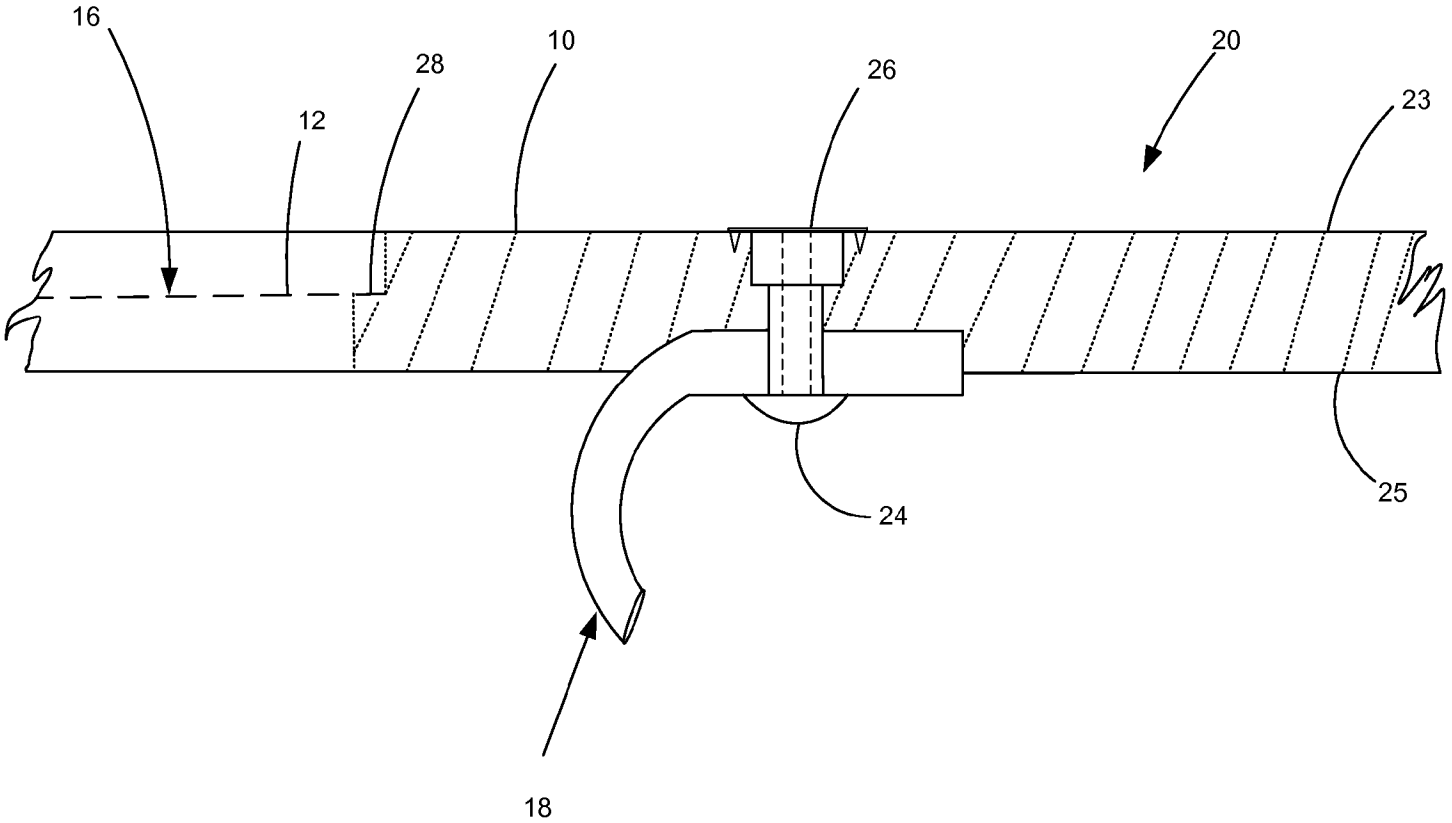
FIG. 5 is a partial cross-section illustrating the tilting bracket.

With reference to FIG. 5, it can be appreciated that frame 10 includes opening 16 through which the material is sifted. A countersunk region 28 is formed into the upper surface 23 of frame 10 and extends around the perimeter of opening 16. With brief reference again to FIG. 2, it can be appreciated that screen 12 is disposed between the frame 10 and a plurality of insert members 42, 44, 46, and 48. Accordingly, primary screen 12 is sandwiched between frame 10 and the inserts. The screen 12 and inserts 42 may be retained in the countersunk region 28 with appropriate adhesives, fasteners, or the like. With continued reference to FIG. 5, it can be appreciated that bracket 18 is attached to the underside 25 of the frame 10. In this case, bracket 18 is attached to the frame 10 with fasteners 24 and 26. Fastener 24 may be a machine screw or other threaded fastener that engages a T-nut, self-locking nut, or other fastener 26.

Figure 6:
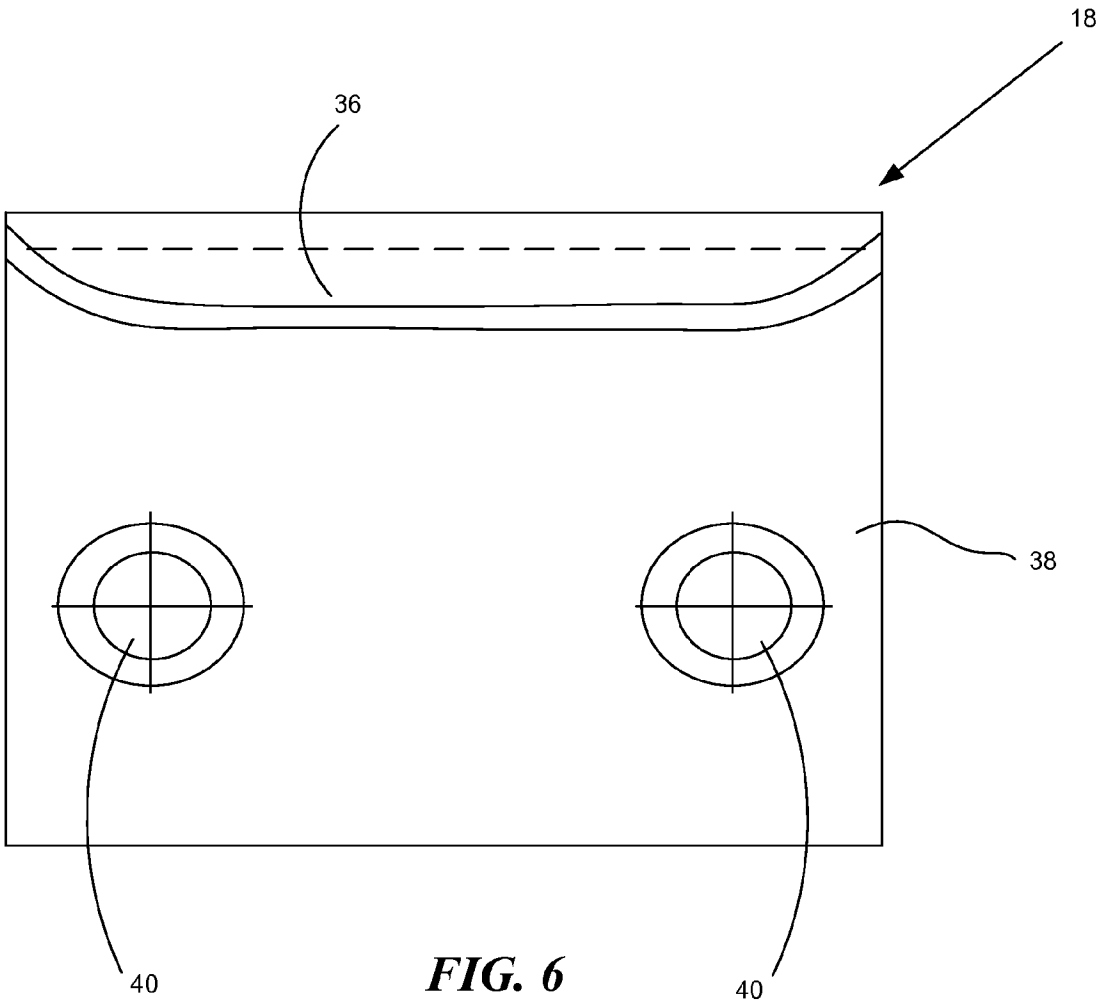
FIG. 6 is a front plan view of the bracket shown in FIG. 5.
Figure 7:
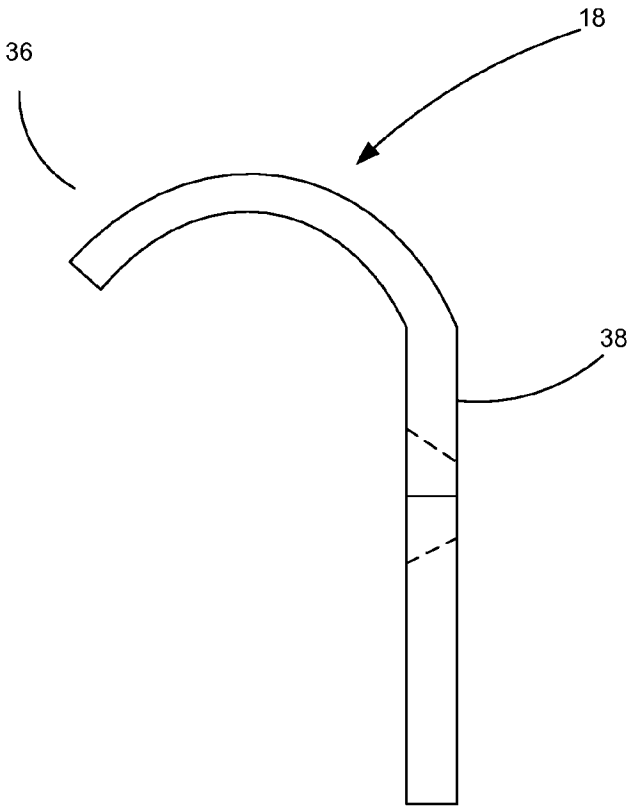
FIG. 7 is a side view in elevation of the bracket shown in FIG. 6.
Figure 8:
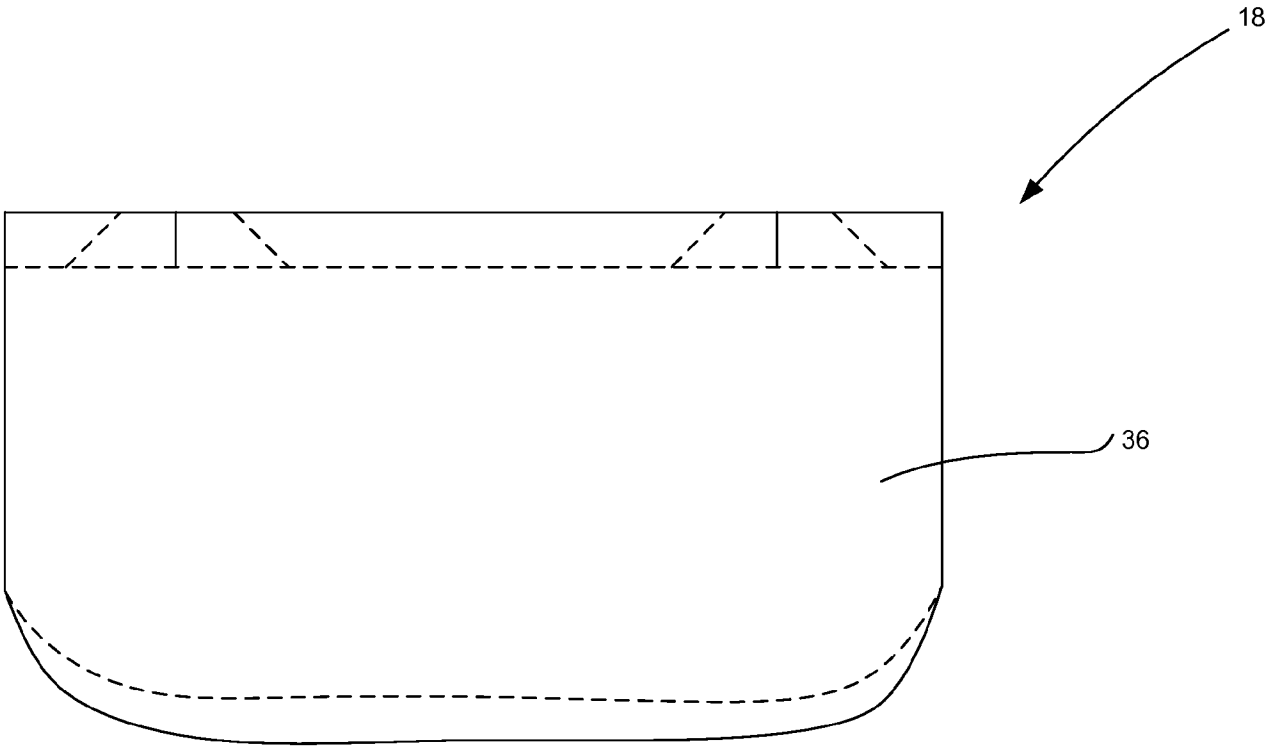
FIG. 8 is a top view of the bracket shown in FIGS. 6 and 7.

FIGS. 6-8 illustrate the construction of bracket 18. In this case, bracket 18 includes attachment portion 38 which is generally planar and includes a pair of countersunk mounting holes 40. Extending from the attachment portion 38 is an arcuate hook portion 36. Referring again to FIG. 5, it can be appreciated that the hook portion 36 is open towards the front, or second end portion 20, of the frame such that when the implement is tilted, it engages the edge 7 of the wheelbarrow container 3.

Figure 9:
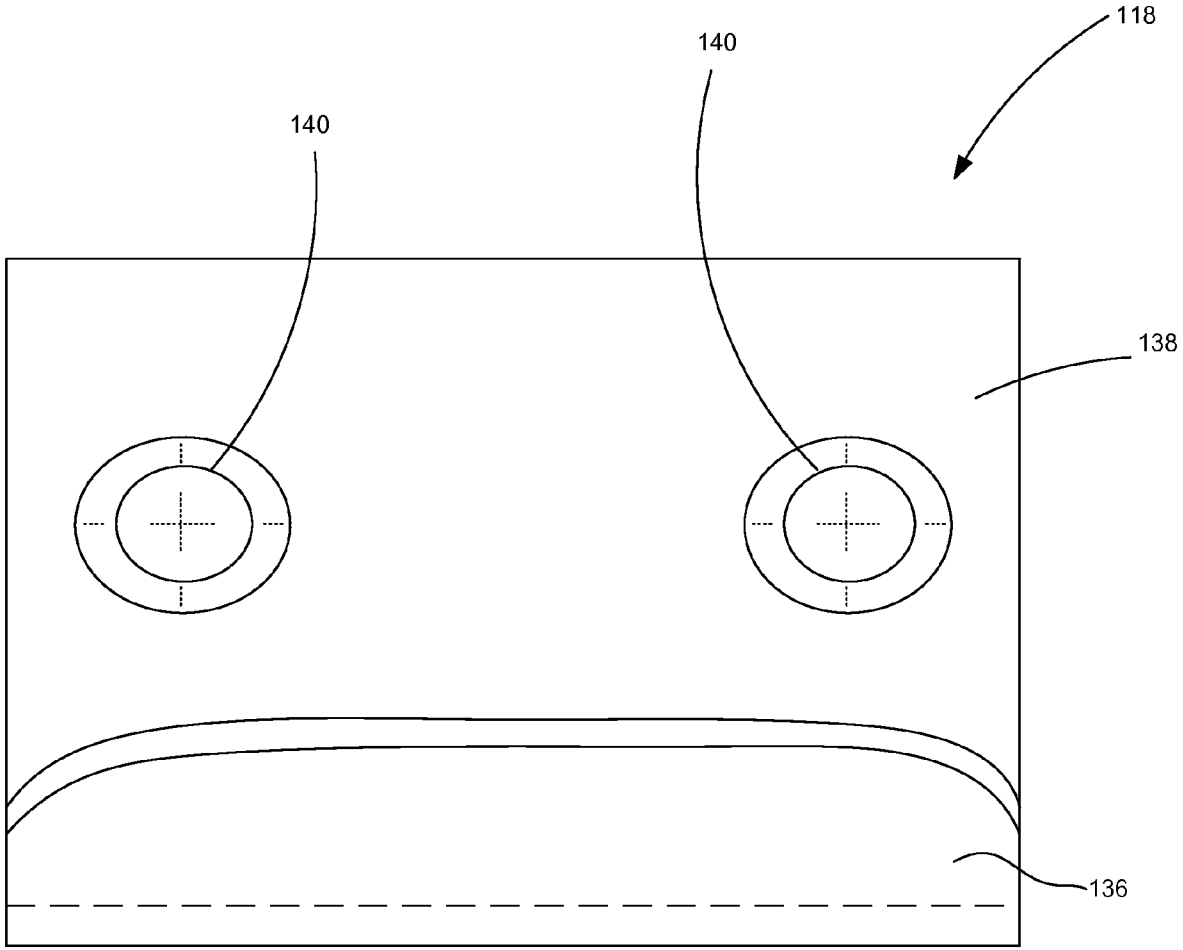
FIG. 9 is an alternative construction of a tilting bracket.
Figure 10:
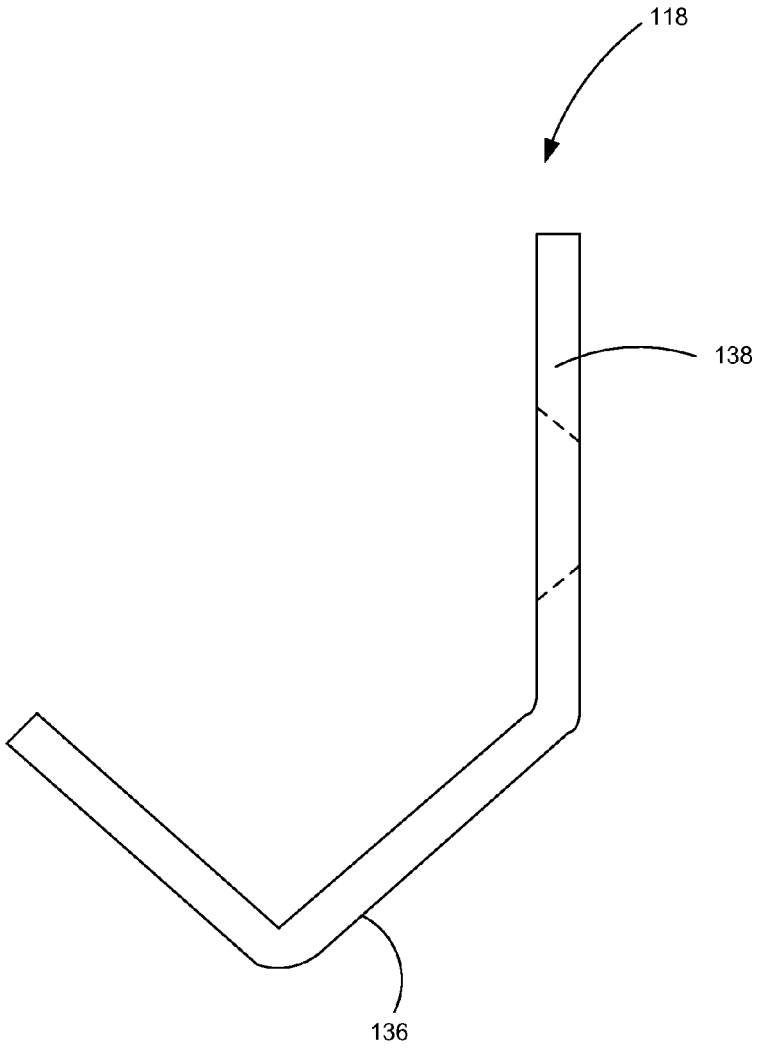
FIG. 10 is a side view in elevation of the bracket shown in FIG. 9.
Figure 11:
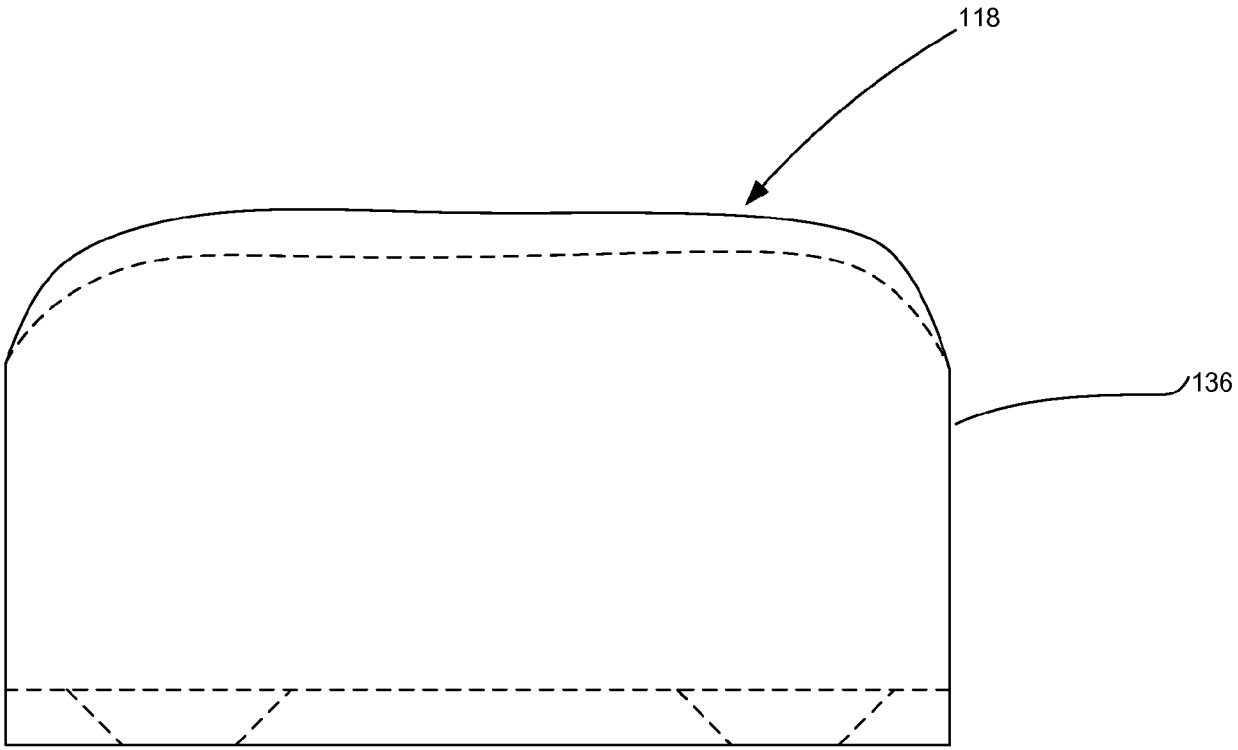
FIG. 11 is a top plan view of the bracket shown in FIGS. 9 and 10.

FIGS. 9-11 illustrate an alternative construction of a bracket 118. Similar to that of the bracket shown in FIGS. 6-8, bracket 118 includes an attachment portion 138 that has a pair of countersunk mounting holes 140. However, extending from the attachment portion 138 is an angular hook portion 136. In this case, the hook portion is formed by forming two bends in the bracket material; one at 45 and another at 90 as shown in FIG. 10. The brackets may be comprised of a suitable material such as steel, aluminum, or other rigid material. It should be understood that while the brackets disclosed have a particular hook shape, other bracket designs may be implemented to engage the edge of an intended container.

Figure 12:
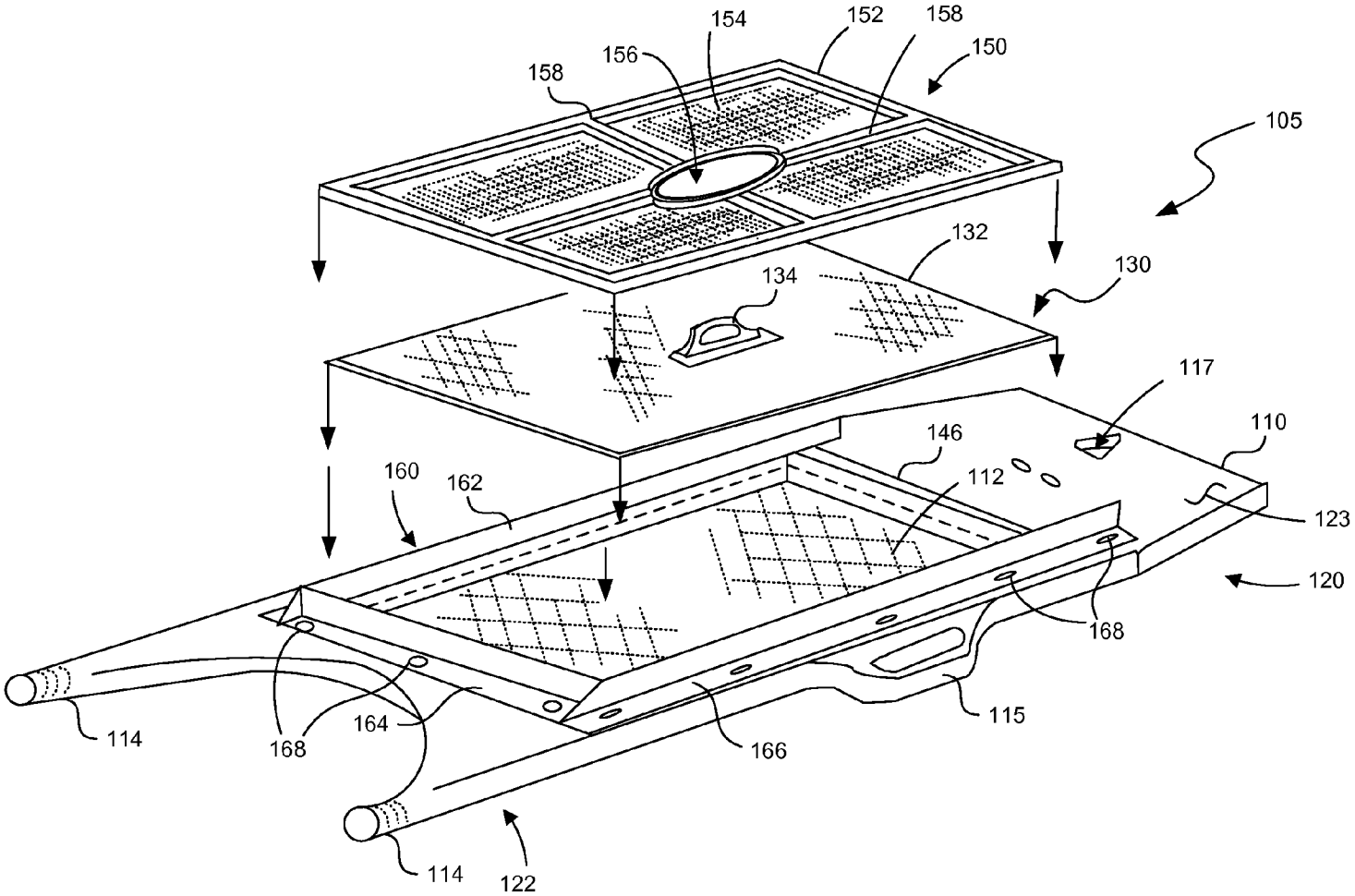
FIG. 12 is a perspective view of a sifting implement according to a second exemplary embodiment.

FIG. 12 illustrates a second exemplary embodiment of a sifting implement 105. In this embodiment, screener implement 105 includes a frame 110 which supports a primary screen 112. Screener implement 105 also includes a secondary screen 130 and a tertiary screen 150. The primary screen 112 and secondary screen 130 may be constructed in a similar fashion to that described above with the first exemplary embodiment. For instance, secondary screen 130 includes a second screen 130 having a handle 134 fastened thereto. The primary and secondary screens have different mesh sizes such as the secondary screen having a smaller mesh size.

Tertiary screen 150 includes a frame 152 that supports a screen 154. Screen 154, in this case, is smaller than both the primary and secondary screen mesh sizes. For example, screen 154 may have a mesh size similar to that of a window screen. Thus, the screen 154 may be comprised of a fine mesh screen material or finely punched sheet metal material. Frame 152 includes a plurality of central support members 158 which support an opening 156. Opening 156 is sized and configured to receive handle 134 therethrough. Accordingly, the secondary screen 130 and tertiary screen 150 may be stacked on top of the primary screen 112 within the screener opening 116. The tertiary screen may be used to sift sand, for example.

Sifting implement 105 also includes a pair of handles 114 disposed on a first end portion 122 of frame 110. As in the first exemplary embodiment, a bracket 118, in this case, is attached to frame 110 on the underside 125 of frame 110. Frame 110 also includes a containment border 160 disposed around opening 116. Containment border 160 facilitates dumping the material off the front or second end portion 120 of the sifting implement. Accordingly, the containment border 160 is open toward the second end portion 120. In this case, containment border 160 is comprised of border segments 162, 164, and 166 which are attached around the perimeter of opening 116 with a plurality of fasteners 168. In this embodiment, the border segments are formed from aluminum angle; however, the border may be formed from other suitable materials such as plastic or steel, for example.

Figure 13:
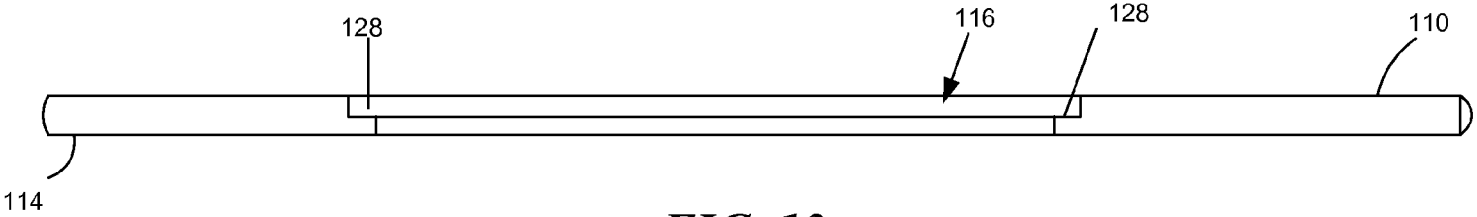
FIG. 13 is a side view in cross-section of the sifting implement frame shown in FIG. 12.
Figure 14:
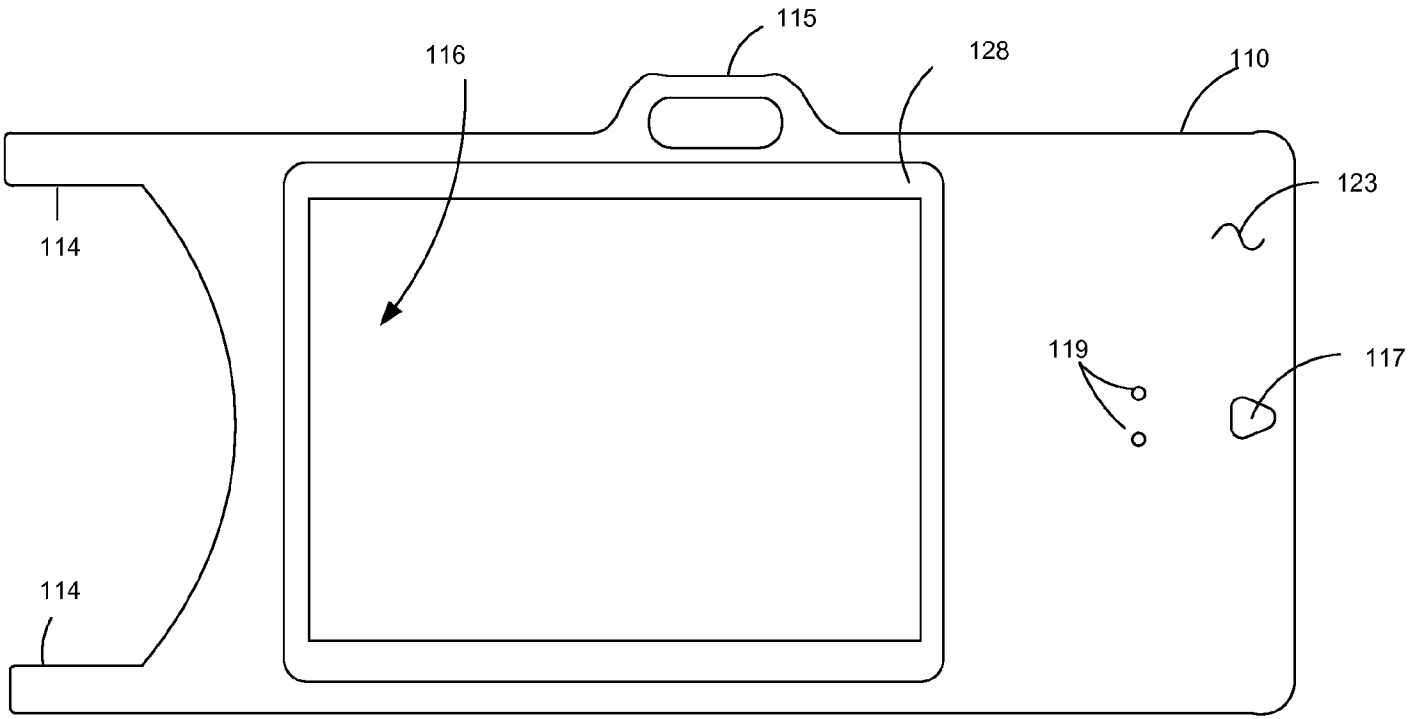
FIG. 14 is a top plan view of the sifting implement frame shown in FIG. 13.
Figure 15:
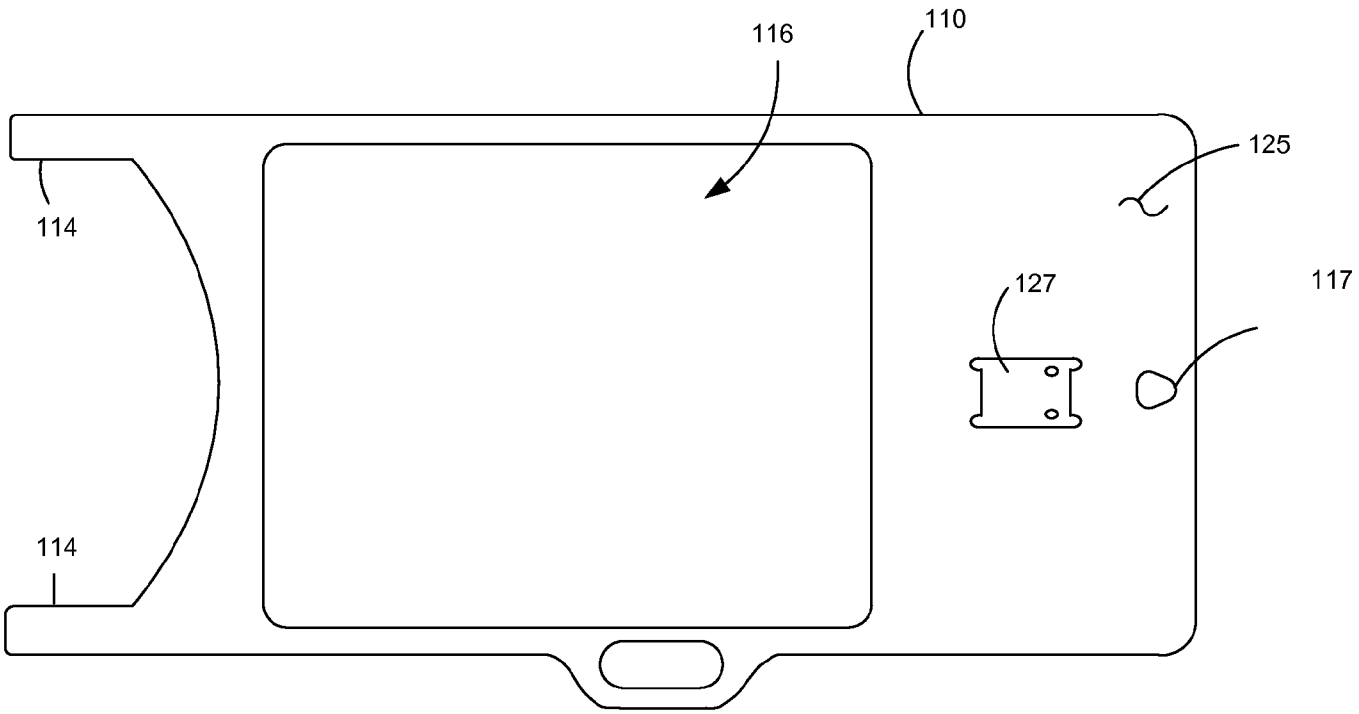
FIG. 15 is a bottom plan view of the sifting implement frame shown in FIGS. 13 and 14.

With reference to FIGS. 13-15, it can be appreciated that frame 110 includes a countersunk region 128 extending around the perimeter of opening 116. As before, the countersunk region 128 is sized to receive screen 112 therein along with a plurality of insert members, such as insert member 146, which retains the primary screen 112 in the opening 116.

With specific reference to FIGS. 14 and 15, it can be appreciated that frame 110 includes a carrying handle 115. Carrying handle 115 may be located along the length of frame 110 between the first end portion 122 and second end portion 120 such that it aligns with the center of gravity of the sifting implement when it is fully assembled. Also, with reference to FIGS. 14 and 15, frame 110 includes a hanging aperture 117 to facilitate storage of the sifting implement by hanging it on a nail or hook, for example. With reference to FIG. 15, the bottom side 125 of frame 110 includes a countersunk region 127 which is sized to receive the attachment portion 138 of a bracket, such as bracket 118. The bracket 118 is attached to frame 110 by using mounting holes 119 and appropriate fasteners as described above.

Figure 16:
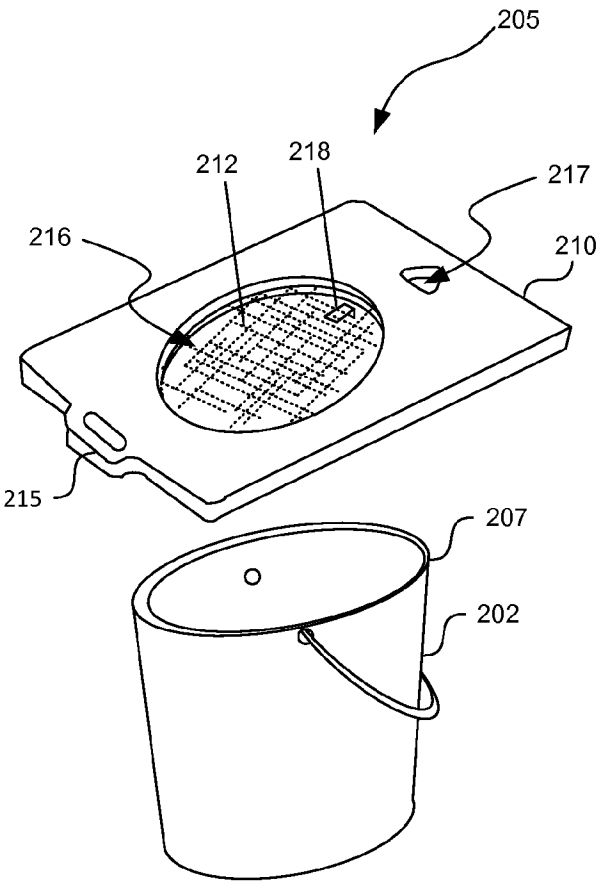
FIG. 16 is a perspective view of a sifting implement according to a third exemplary embodiment for use with a bucket.

FIG. 16 illustrates a sifting implement according to a third exemplary embodiment for use on a bucket 202. In this embodiment, the sifting implement 205 is designed to be used with a bucket 202. Sifting implement 205 includes a frame 210 that has a circular opening 216 with a screen 212 supported therein. The frame 210 also includes a handle 215 and a hanging aperture 217. The frame 210 is sized to be placed on top of a bucket 202 and includes a tilting bracket 218 which is operative to engage the edge or lip 207 of bucket 202. In this case, the bracket 218 is attached to screen 212. Although shown here to be attached to screen 212, bracket 218 may also be attached to the frame 210. Accordingly, the sifting implement 205 may be tilted with respect to bucket 202 as explained above with respect to the first and second embodiments.

Figure 17:
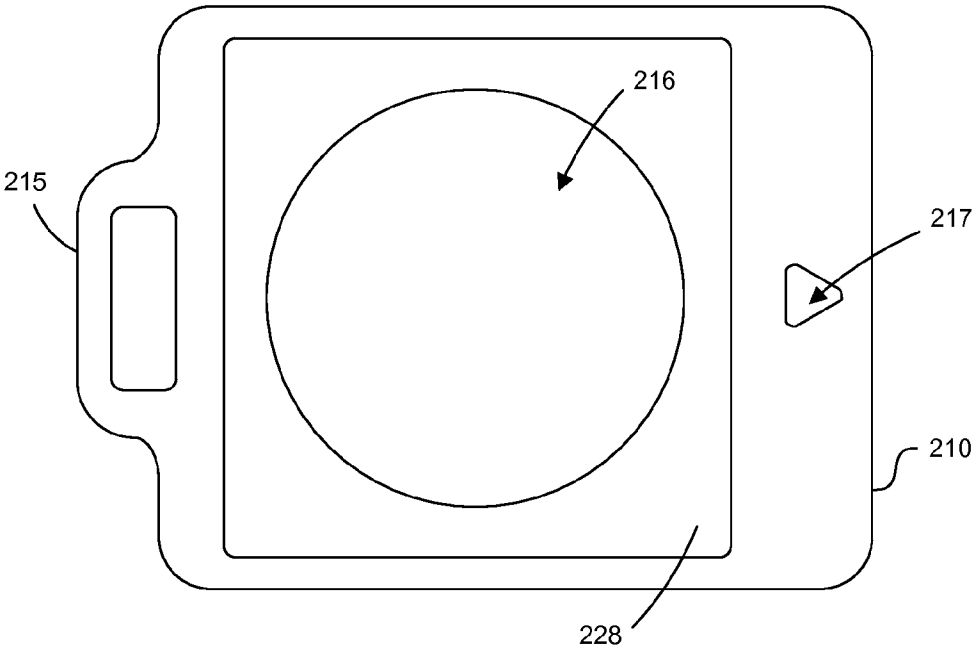
FIG. 17 is a bottom plan view of the sifting implement frame shown in FIG. 16.
Figure 18:
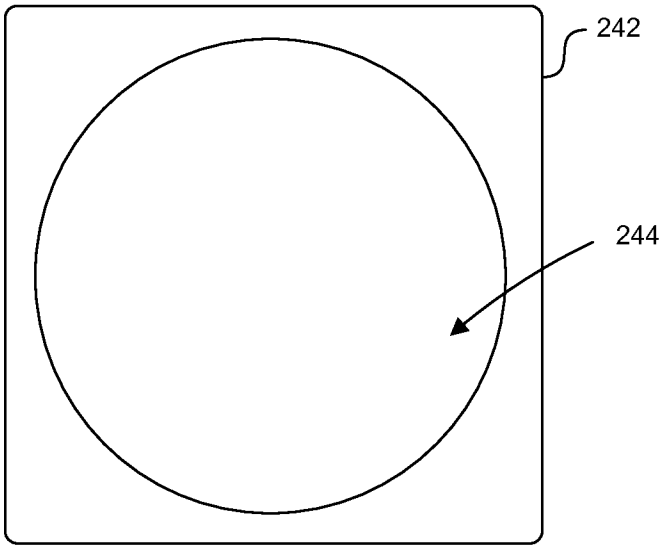
FIG. 18 is a top plan view of the insert for use with the sifting implement shown in FIG. 16.
Figure 19:
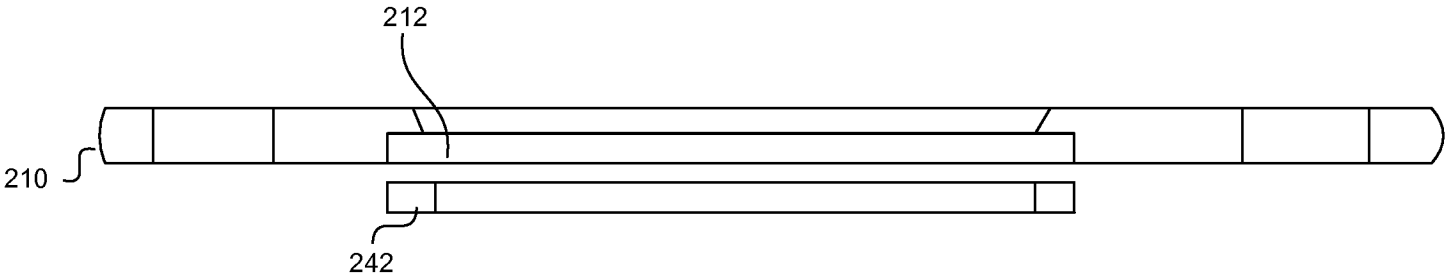
FIG. 19 is an exploded cross-section view of the sifting implement shown in FIG. 16.
Figure 21:
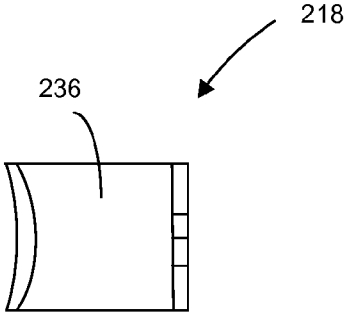
FIG. 21 is an end view of the bracket shown in FIG. 20.
Figure 22:
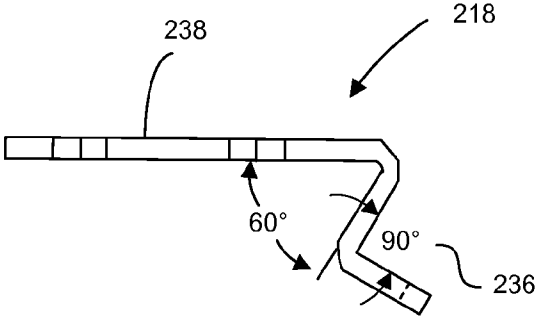
FIG. 22 is a side view of the bracket shown in FIGS. 20-21.
Figure 20:
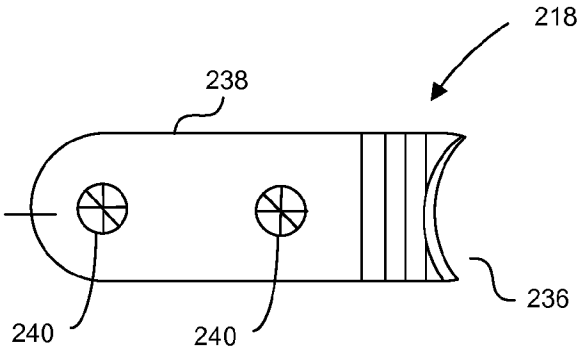
FIG. 20 is a top plan view of a bucket tilting bracket as shown in FIG. 16.

With reference to FIGS. 17-19, frame 210 includes a countersunk region 228 which is sized and configured to receive an insert 242. Screen 212 is disposed in opening 216 between the insert 242 and the countersunk region 228 of frame 210. Furthermore, it should be appreciated with reference to FIG. 18 that insert 242 includes an opening 244 that is a suitably larger size than opening 216 so as to accommodate, with some slack, the top edge diameter 207 of the bucket 202. FIGS. 20-22 illustrate the construction of bucket tilting bracket 218. In this case, bracket 218 includes attachment portion 238 which is generally planar and includes a pair of mounting holes 240. Extending from the attachment portion 238 is a hook portion 236. Referring again to FIG. 16, it can be appreciated that the hook portion 236 is open towards the inside edge 207 of the bucket 202 such that when the implement is tilted, it engages the edge 207 of the bucket. As shown in FIG. 22, the hook portion 236 is formed with two bends. In this case the hook bends toward the attachment portion 238 at approximately 60°. The hook then bends away from the attachment portion 238 at approximately 90°. The hook angles shown are for example only and may vary.

Methods relating to the above described sifting implement are also contemplated. The methods thus encompass the steps inherent in the above described structures and operation thereof. In an exemplary embodiment, the method may comprise supporting a first screen of a first mesh size above a container, such as a wheelbarrow; placing a material to be sifted on top of the screen; and agitating the material by use of the handle on the secondary screen, or by hand such that smaller portions of the material fall through the screen and larger materials are separated and remain on top of the screen. Subsequently, the larger materials are dumped off the screen by tilting the screen from one end or by lifting the secondary screen by its handle and dumping oversize materials off as discard or to be otherwise used. The method may further comprise preventing the screen from moving relative to an edge of the container as the screen is tilted. The method may further comprise placing a second screen of a different mesh size on top of the first screen and thereafter agitating material through the second screen.

In another exemplary embodiment, the method may include supporting a first screen in a frame; placing the frame on top of a container; placing a material to be sifted on top of the screen; and agitating the material by use of the handle on the secondary screen, or by hand such that smaller portions of the material fall through the screen and larger materials are separated and remain on top of the screen. Subsequently, the larger materials are dumped off the screen by tilting the frame from one end or by lifting the secondary screen by its handle and dumping oversize materials off as discard or to be otherwise used. The method may further comprise preventing the frame from moving relative to an edge of the container as the screen is tilted. The method may further comprise engaging an edge of the container thereby preventing the frame from moving relative to an edge of the container as the screen is tilted.

A method of repotting a plant is also contemplated. In an exemplary embodiment, the method may include supporting a screen above a container, such as a wheelbarrow or bucket; placing a potted plant on top of the screen; removing the pot from the potted plant; and agitating the potting soil material by hand or against the screen such that smaller portions of the soil fall away from the root mass and through the screen and larger materials, including the plant and roots, are separated and remain on top of the screen. Repotting in a larger vessel with additional fresh potting soil logically follows.

Accordingly, the sifting implement and methods of using the same have been described with some degree of particularity directed to the exemplary embodiments. It should be appreciated; however, that the present invention is defined by the following claims construed in light of the prior art so that modifications or changes may be made to the exemplary embodiments without departing from the inventive concepts contained herein.

What is claimed is:

1. A sifting implement for use with a container, the implement comprising:

a frame having an opening;

a primary screen supported in the opening;

a pair of handles disposed on a first end of the frame;

a bracket including:

an attachment portion attached to the implement on a second end of the frame opposite the first end, and a hook portion operative to engage an edge of the container, wherein the hook portion opens toward the second end of the frame; and a containment border disposed around the opening, wherein the containment border includes an opening toward the second end of the frame.

2. The implement according to claim 1, wherein the hook portion is arcuate.

3. The implement according to claim 1, further comprising a secondary screen disposed in the opening adjacent the primary screen.

4. The implement according to claim 3, including a handle disposed on the secondary screen.

5. The implement according to claim 3, wherein the primary screen has a first mesh size and the secondary screen has a second mesh size smaller than the first mesh size.

6. The implement according to claim 5, further comprising a tertiary screen disposed in the opening adjacent the secondary screen.

7. A sifting implement for use with a wheelbarrow, the implement comprising:

an elongate frame including first and second end portions and a rectangular opening disposed therebetween;

a primary screen supported in the opening;

a pair of handles disposed on the first end portion;

a containment border disposed around the opening, wherein the containment border includes an opening toward the second end portion; and a bracket attached to the second end portion and operative to engage an edge of a wheelbarrow container, wherein the bracket includes a hook portion open toward the second end portion.

8. The implement according to claim 7, further comprising at least one insert member disposed in a countersunk region formed in the frame, wherein the screen is disposed in the countersunk region between the insert and frame.

9. The implement according to claim 7, further comprising a secondary screen disposed in the opening adjacent the primary screen.

10. The implement according to claim 7, further comprising a carrying handle located along a length of the frame such that it aligns with the center of gravity of the sifting implement when fully assembled.

11. The implement according to claim 7, wherein the hook portion is arcuate.

12. A sifting implement for use with a bucket, the implement comprising:

a frame including a circular opening;

a screen supported in the opening;

a handle disposed on the frame;

a containment border disposed around the opening, wherein the containment border includes an opening opposite the handle; and a bracket disposed on the implement opposite the handle and adjacent a perimeter of the opening, wherein the bracket includes a hook portion open opposite the handle and operative to engage an edge of a bucket.

13. The implement according to claim 12, further comprising an insert disposed in a countersunk region formed in the frame, wherein the screen is disposed in the countersunk region between the insert and frame.

14. The implement according to claim 12, wherein the bracket is disposed on the screen.

15. The implement according to claim 12, wherein the hook portion is arcuate.

* * * * *